US005445276A

United States Patent [19]

Gordon

[11] Patent Number: 5,445,276

[45] Date of Patent: Aug. 29, 1995

[54] FOOD CONTAINER ATTACHMENT FOR LUNCH PAILS AND COOLERS

[76] Inventor: Delbert L. Gordon, 233 Laurel St., Lake Jackson, Tex. 77566

[21] Appl. No.: 270,734

[22] Filed: Jul. 5, 1994

Related U.S. Application Data

[63] Continuation-in-part of Ser. No. 18,353, Feb. 17, 1993, Pat. No. 5,325,969.

[51] Int. Cl.[6] ..... B65D 81/38

[52] U.S. Cl. ..... 206/545; 206/546; 220/23.83

[58] Field of Search ..... 150/108, 113; 206/541-549; 220/4.26, 23.83, 503, 505, 555; 224/202; 383/110

[56] References Cited

U.S. PATENT DOCUMENTS

| | | | |
|---|---|---|---|
| 265,742 | 10/1882 | Boteler | 206/549 |
| 669,697 | 5/1902 | Missotten | 206/546 |
| 2,652,698 | 9/1953 | Schlumbohm | 206/545 |
| 3,521,808 | 7/1970 | Weiss | 220/555 |
| 3,692,208 | 9/1972 | Croyle et al. | 220/307 |
| 4,068,786 | 1/1978 | Taniguchi | 150/108 |
| 4,679,242 | 7/1987 | Brockhaus | 383/110 |
| 5,116,306 | 5/1992 | Zander | 224/202 |
| 5,181,612 | 1/1993 | Liu | 206/542 |

*Primary Examiner*—Jimmy G. Foster
*Attorney, Agent, or Firm*—Kenneth A. Roddy

[57] ABSTRACT

A removable food container attachment for lunch pails and small coolers includes a sling member formed of flexible material having a bottom wall and opposed end portions and side portions extending upwardly therefrom to define a generally rectangular compartment which receives one or more bowl-shaped food containers each having an air tight lid. In a preferred embodiment, the bottom and sides of the compartment are of double wall construction and filled with thermally insulating material. A flexible insulating cover removably received on the top of the covered food container encloses the top end of the sling compartment. The sling compartment with the insulating cover installed is placed on the bottom of a conventional lunch pail or small cooler. A flexible strap connected to one side portion extends over the top of the pail or cooler and a releasable fastener connected with the strap and with the other side portion releasably secures the sling onto the pail or cooler and the assembly is conveniently carried as a single unit. One or more small pockets may be provided on the exterior of the sling for holding eating utensils and other items. Conventional covered food containers, microwaveable dishes, or one or more conventional frozen dinner packages may be carried in the sling compartment. Wholesome plate lunches prepared in advance may be placed in containers, stored in an refrigerator or freezer, transported in the attachment, and when desired, microwaved for consumption.

18 Claims, 2 Drawing Sheets

FOOD CONTAINER ATTACHMENT FOR LUNCH PAILS AND COOLERS

CROSS REFERENCE TO RELATED APPLICATION

This application is a Continuation-In-Part of U.S. patent application Ser. No. 08/018,353 filed Feb. 17, 1993, now U.S. Pat. No. 5,325,969.

BACKGROUND OF THE INVENTION

1. Field of the Invention

This invention relates generally to lunch pails and coolers, and more particularly to a removable food container attachment for lunch pails and coolers having a compartment for carrying plate lunches and other articles.

2. Brief Description of the Prior Art

In the work world of today, we have come a long way from carrying our lunch in a brown paper bag. Lunch pails and small coolers are widely popular means of carrying lunches. One of the major problems with current lunch pails and small coolers is that most of them have only a single carrying compartment with perhaps one small tray insert. Many people would prefer to carry a plate lunch, be it homemade or store bought, due to the availability of microwave ovens in work places. Most lunch pails and small coolers of today are not designed to carry a plate lunch, but rather sandwiches, fruit, beverages, and maybe a few small containers.

Therefore, I have designed a removable food container attachment for lunch pails and small coolers which provides a detachable compartment which can be attached to lunch pails and small coolers and used to carry plate lunches while still maintaining the lunch pail or cooler compartment for snacks, fruit, drinks, and other desired articles.

There are several patents which disclose lunch pails and connectable containers. Ruiz, U.S. Pat. No. 3,372,690 discloses an insulated lunch box having an insulated base portion with an upper tray-supporting surface with side panels hingedly connected at their bottom ends to the base portion to define a single compartment. Each of the side panels pivot to a vertical position and are provided with a groove on their inner surface which is positioned parallel to the upper tray-supporting surface of the base portion. A food tray having a peripheral horizontal flange is removably received on the tray-supporting surface of the base portion with its horizontal flange resting on the vertical flange of the base portion. The food tray is covered by a cover having outer edges which are folded over the horizontal flange of the food tray. The outer periphery of horizontal flange of the food tray and cover is received in the grooves of the side portions when they are vertically disposed.

Clubb, U.S. Pat. No. 4,078,701 discloses a multi-vessel container unit wherein either vessel is used to carry ice and/or liquids. The Clubb device has separate vessels removably mounted one on top of the other and held together by hinged clamps. The upper vessel is uninsulated and has a vertical pouring spout of sufficient diameter to receive and pass ice cubes therethrough and the lower vessel is insulated and has an open top end to receive .ice cubes and a pouring spout on the side of sufficient diameter to prevent the passage of ice cubes therethrough. The bottom of the upper vessel is received in the open top end of the lower vessel. An insulating cover may be placed in the lower vessel a short distance below the open top end to prevent heat exchange between the two vessels.

The present invention is distinguished over the prior art in general, and these patents in particular by a removable food container attachment for lunch pails and small coolers which includes a sling member formed of flexible material having a bottom wall and opposed end portions and side portions extending upwardly therefrom to define a generally rectangular compartment which receives one or more bowl-shaped food containers each having an air tight lid. In a preferred embodiment, the bottom and sides of the compartment are of double wall construction and filled with thermally insulating material. A flexible insulating cover removably received on the top of the covered food container encloses the top end of the sling compartment. The sling compartment with the insulating cover installed is placed on the bottom of a conventional lunch pail or small cooler. A flexible strap connected to one side portion extends over the top of the pail or cooler and a releasable fastener connected with the strap and with the other side portion releasably secures the sling onto the pail or cooler and the assembly is conveniently carried as a single unit. One or more small pockets may be provided on the exterior of the sling for holding eating utensils and other items. Conventional covered food containers, microwaveable dishes, or one or more conventional frozen dinner packages may be carried in the sling compartment° Wholesome plate lunches prepared in advance may be placed in containers, stored in a refrigerator or freezer, transported in the attachment, and when desired, microwaved for consumption.

SUMMARY OF THE INVENTION

It is therefore an object of the present invention to provide a removable food container attachment for lunch pails and small coolers whereby the lunch pail or cooler serves as a first food or beverage compartment for containing one type of food such as sandwiches or beverages and the food container attachment provides a second compartment for containing another type of food such as a plate lunch.

It is another object of this invention to provide a removable food container attachment for lunch pails and small coolers which carries a food container which may be removed therefrom and stored in a refrigerator or freezer until needed.

Another object of this invention is to provide a removable food container attachment for lunch pails and small coolers which carries a food container which may be removed therefrom and placed in a microwave oven for heating or preparing the food contained therein.

Another object of this invention is to provide a removable food container attachment for lunch pails and small coolers which carries a food container and is easily and quickly attached to a conventional lunch pail or small cooler whereby the assembly is conveniently carried as a single unit.

A further object of this invention is to provide a removable food container attachment for lunch pails and small coolers which has a thermally insulated compartment which may be used to contain commercially available covered food containers and frozen dinners.

A still further object of this invention is to provide a removable food container attachment for lunch pails and small coolers which has a compartment and one or more bowl-shaped food containers and covers therefor which fit inside the compartment and are microwave, freezer, and dishwasher safe, whereby several meals may be prepared in advance and placed in individual containers, stored in a refrigerator or freezer, transported in the attachment, and when desired, placed in a microwave oven for preparing the food contained therein.

Other objects of the invention will become apparent from time to time throughout the specification and claims as hereinafter related.

The above noted objects and other objects of the invention are accomplished by a removable food container attachment for lunch pails and small coolers which includes a sling member formed of flexible material having a bottom wall and opposed end portions and side portions extending upwardly therefrom to define a generally rectangular compartment which receives one or more bowl-shaped food containers each having an air tight lid. In a preferred embodiment, the bottom and sides of the compartment are of double wall construction and filled with thermally insulating material. A flexible insulating cover removably received on the top of the covered food container encloses the top end of the sling compartment. The sling compartment with the insulating cover installed is placed on the bottom of a conventional lunch pail or small cooler. A flexible strap connected to one side portion extends over the top of the pail or cooler and a releasable fastener connected with the strap and with the other side portion releasably secures the sling onto the pail or cooler and the assembly is conveniently carried as a single unit. One or more small pockets may be provided on the exterior of the sling for holding eating utensils and other items. Conventional covered food containers, microwaveable dishes, or one or more conventional frozen dinner packages may be carried in the sling compartment. Wholesome plate lunches prepared in advance may be placed in containers, stored in a refrigerator or freezer, transported in the attachment, and when desired, microwaved for consumption.

DESCRIPTION OF THE PREFERRED EMBODIMENT

Figure 1:
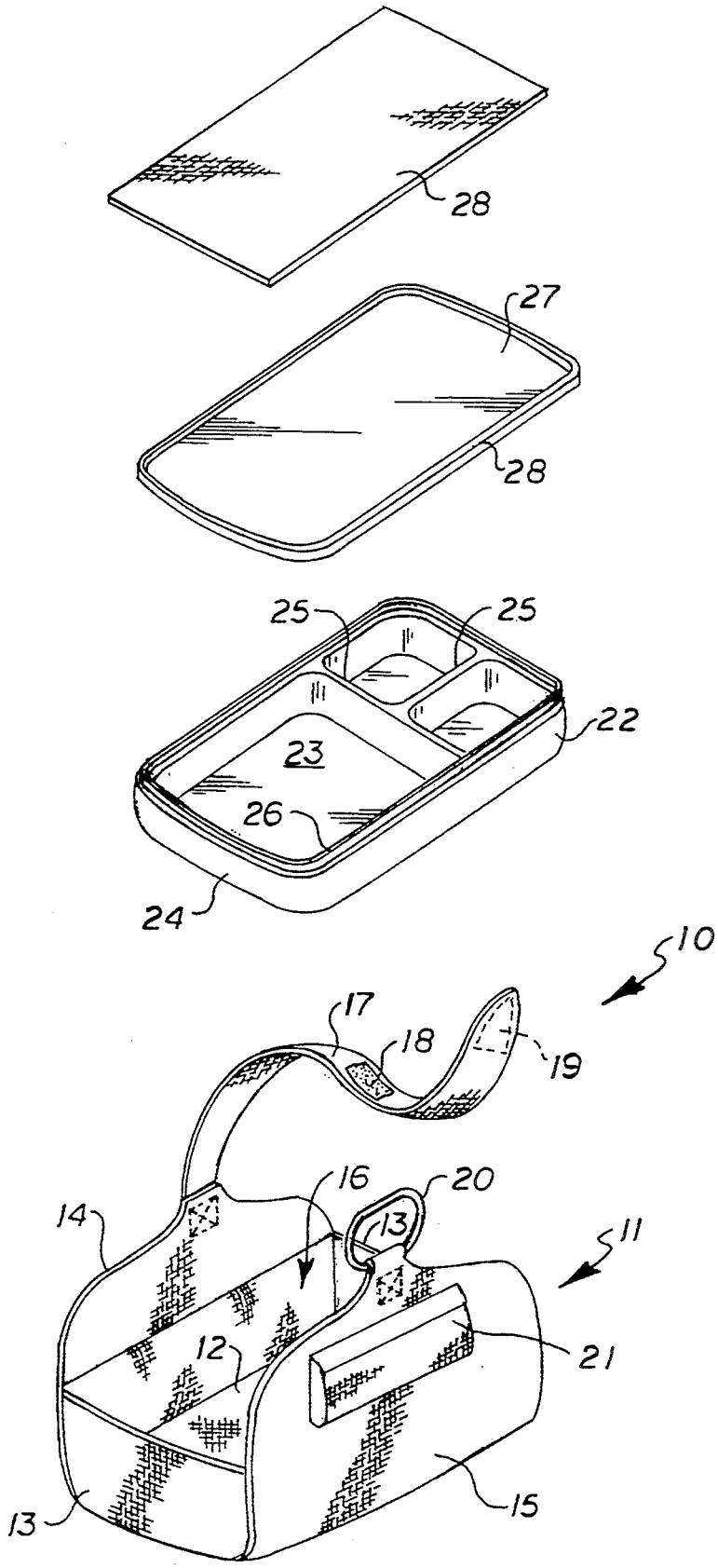
FIG. 1 is an exploded isometric view of a preferred food container attachment for lunch pails and small coolers in accordance with the present invention, shown with the sling member, food container, lid member, and insulating cover member in an unassembled condition.

Referring to the drawings by numerals of reference, there is shown in FIG. 1, the main components of a food container attachment 10 for lunch pails and small coolers. The components of the food container attachment include a sling member 11 which is formed of suitable flexible material or fabric. The preferred sling 12 has a bottom wall 12, opposed end portions 13 and side portions 14 and 15 extending upwardly from the bottom wall and secured together at the corners to define a generally rectangular compartment 16. The side portions 14 and 15 extend upwardly beyond the end portions 13 and taper inwardly. An elongate strap 17 is secured at one end to one of the side portions 14. A strip 18 of one element of hook and loop fastener material is secured to the exterior of the strap 17 a distance from its end, and a mating element 19 of the hook and loop fastener material is secured at the end of the strap. A D-ring 20 is secured to the upper end of the other side portion 15.

It should be understood that other suitable fastener means may be used in place of the hook and loop fasteners and D-ring, such as a belt and buckle arrangement or snap fasteners.

In the preferred embodiment, the bottom wall 12, opposed end portions 13 and the lower portion of the side portions 14 and 15 are of double wall construction and are filled with a suitable thermally insulating material. A small pocket 21 may be provided on the exterior of one or more of the side or end portions for holding knives, forks, spoons, and various other small items, such as containers of condiments, etc.

The compartment 16 of the sling 11 is sized to receive one or more bowl-shaped food containers 22 having a bottom wall 23 and an upstanding side wall 24 extending upwardly therefrom. A preferred food container 22 has a plurality of upstanding interior walls 25 dividing it into separate sections for containing different food products whereby a plate lunch type of meal may be contained therein. An upstanding lip 26 extends around the periphery of the open top end of the food container 22. A lid member 27 is provided for each food container 22 which has a peripheral rim 28 sized and shaped to be removably engaged on the lip 26 of the container and form an air tight seal thereon. The depth of the food containers 22 and the sling compartment 16 may be sized such that a plurality of covered containers may be stacked within the compartment.

The food containers 22 are preferably formed of a durable plastic material that is microwave, freezer and dishwasher safe. Several containers and lids may be provided as accessories for the convenience of preparing and storing several meals in advance.

It should be understood that conventional covered food containers may also be used, such as Tupperware (TM) and microwaveable dishes, or one or more conventional frozen dinner packages may be carried in the sling compartment.

A generally rectangular insulating cover 29 formed of flexible material or fabric of double wall construction filled with a suitable thermally insulating material is removably received on the top of the lid 27 of the food container 22 to enclose the top end of the sling compartment 16.

Figure 2:
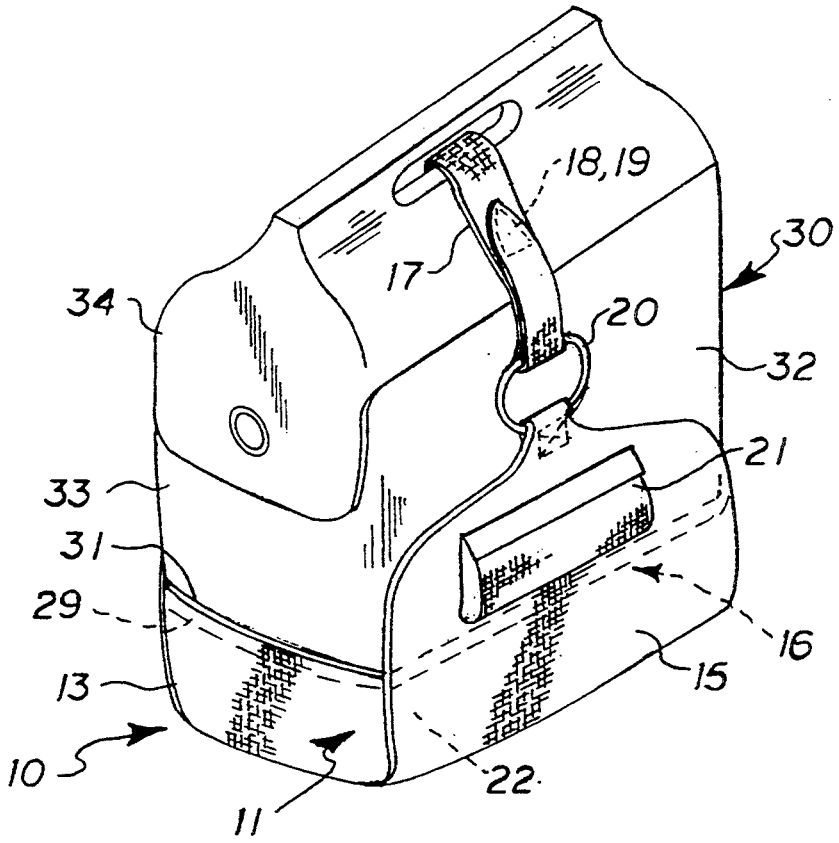
FIG. 2 is a perspective view of the food container attachment installed on a lunch pail or cooler.

As shown in FIG. 2, the sling 11 with one or more food containers 22 therein is releasably installed on a conventional lunch pail or small insulated cooler 30. The lunch pail or cooler has a bottom wall 31, opposed side walls 32 and end walls 33 extending upwardly therefrom defining a food and beverage compartment, an open and closable lid 34 at an upper end of the side walls and end walls defining a closure for the food and beverage compartment, and a handle for carrying the lunch pail or cooler.

The removable food container attachment 10 is installed on the lunch pail or cooler 30 by placing the bottom end 31 of the pail or cooler into the sling compartment 16 on top of the insulating cover 29, bringing the side walls 14 and 15 upwardly along the sides 32 of the pail or cooler, feeding the strap 17 through the D-ring 20, and securing the mating elements 18 and 19 of the hook and loop fastener together. The lunch pail or cooler with the attachment 10 installed is conveniently carried as a single unit.

When the food container attachment 10 is installed on the lunch pail or cooler, the lunch pail or cooler may be used for containing ice and drinks and the attachment 10 provides an isolated and insulated secondary compartment for carrying various types of lunches and other articles. For example, soups, sandwiches, or a frozen dinner may be carried in the sling compartment 16 and while the lunch pail or cooler may be used to carry beverages or other items. Thus, several meals may be prepared in advance by using by using a microwave oven or other means, placed into the food containers, and stored in a refrigerator or freezer until needed. The food containers can then be carried to the work place along with the lunch pail or cooler in the container attachment 10. The food containers can then be removed and placed in a refrigerator or freezer at the work place and then at lunch time, they can be placed in a microwave oven to heat the meal contained therein.

While this invention has been described fully and completely with special emphasis upon a preferred embodiment, it should be understood that within the scope of the appended claims the invention may be practiced otherwise than as specifically described herein.

I claim:

1. A food container attachment for removable installation on lunch pails and small coolers which have a bottom wall, side walls and a top, to form a secondary compartment for carrying different types of lunches and other articles comprising:

a sling member formed of flexible material having a bottom wall and opposed end portions and opposed side portions extending upwardly therefrom to define a generally rectangular compartment sized be received beneath the bottom wall of the pail or cooler and to enclose a food container;

a generally rectangular thermally insulated cover member removably received within said sling compartment between the bottom of the pail or cooler and the top of the food container to enclose said compartment and insulate the food container enclosed within said compartment;

an elongate strap member connected to one of said opposed side portions and being of sufficient length to pass over the top of the pail or cooler; and releasable fastener means connected with said strap member and with the other one of said opposed side portions for releasably securing said strap member over the top of the pail or cooler; whereby a food container containing food and other articles of one type is releasably secured beneath the bottom of the pail or cooler and is conveniently carried with the pail or cooler as a single unit and isolated from food, beverages and other articles of another type contained in the pail or cooler.

2. The food container attachment according to claim 1 in which said sling bottom wall, opposed end portions, and a lower portion of said side portions are thermally insulated.

3. The food container attachment according to claim 2 in which said sling bottom wall, opposed end portions, and a lower portion of said side portions are of double wall construction and are filled with thermally insulating material.

4. The food container attachment according to claim 1 in which said cover member is formed of flexible material of double wall construction and filled with thermally insulating material.

5. The food container attachment according to claim 1 including at least one pocket member on at least one of said sling side or end portions for containing various articles.

6. The food container attachment according to claim 1 in which said fastener means comprises mating elements of hook and loop fastener material.

7. The food container attachment according to claim 1 including at least one bowl-shaped food container removably received within said sling compartment.

said food container having a bottom wall and a contiguous side wall extending upwardly therefrom with an upstanding lip around the periphery of said side wall, and a lid closure for each said food container having a peripheral rim removably engaged on the lip of said container configured to form an air tight seal thereon.

8. The food container attachment according to claim 7 in which said at least one bowl-shaped food container has interior walls dividing it into separate sections for containing different food products.

9. The lunch kit according to claim 1 including at least one pocket member on at least one of said sling side or end portions for containing various articles.

10. The lunch kit according to claim 1 in which said fastener means comprises mating elements of hook and loop fastener material.

11. A lunch kit having a first food and beverage compartment and a detachable second food compartment for selectively carrying different types of lunches and other articles comprising in combination:

an upper member having a bottom wall, opposed side walls and end walls extending upwardly therefrom defining a first food and beverage compartment, an open and closable lid at an upper end of said side walls and end walls defining a closure for said first food and beverage compartment, and a handle on said upper member for carrying said upper member;

a sling member formed of flexible material having a bottom wall and opposed end portions and opposed side portions extending upwardly therefrom to define a generally rectangular second compartment sized be received beneath the bottom wall of said upper member and to enclose a food container;

a generally rectangular thermally insulated cover member removably received within said sling second compartment between said upper member bottom wall and the top of the enclosed food container to enclose said second compartment and insulate the food container enclosed within said second compartment;

an elongate strap member connected to one of said opposed side portions and being of sufficient length to pass over said upper member open and closable lid;

releasable fastener means connected with said strap member and with the other one of said opposed side portions for releasably securing said strap member over said upper member open and closable lid; whereby a food container containing food and other articles of one type is releasably secured beneath the bottom of said upper member and is conveniently carried therewith as a single unit and isolated from food, beverages and other articles of another type contained in said upper member; and said upper member being selectively capable of use independently of said sling member when disconnected therefrom for containing food, beverages, and other articles.

12. The lunch kit according to claim 11 in which said sling bottom wall, opposed end portions, and a lower portion of said side portions are thermally insulated.

13. The lunch kit according to claim 11 in which said cover member is formed of flexible material of double wall construction and filled with thermally insulating material.

14. The lunch kit according to claim 11 including at least one bowl-shaped food container removably received within said sling second compartment, said container having a bottom wall and a contiguous side wall extending upwardly therefrom with an upstanding lip around the periphery of said side wall, and a lid closure for each said food container having a peripheral rim removably engaged on the lip of said container configured to form an air tight seal thereon.

15. The lunch kit according to claim 14 in which said at least one bowl-shaped food container has interior walls dividing it into separate sections for containing different food products.

16. The lunch kit according to claim 11 in which said upper member is a lunch pail.

17. The lunch kit according to claim 11 in which said upper member is an insulated cooler suitable for containing ice, beverages, and other articles.

18. An insulated cooler having a first food and beverage compartment and a detachable second food compartment for selectively carrying different types of lunches and other articles comprising in combination:

a thermally insulated cooler having a bottom wall, opposed side walls and end walls extending upwardly therefrom defining a first food and beverage compartment, an open and closable lid at an upper end of said side walls and end walls defining a closure for said first food and beverage compartment, and a handle on said cooler for carrying said cooler;

a sling member formed of flexible material having a bottom wall and opposed end portions and opposed side portions extending upwardly therefrom to define a generally rectangular second compartment sized be received beneath the bottom wall of said cooler and to enclose a food container;

a generally rectangular thermally insulated cover member removably received within said sling second compartment between said upper member bottom wall and the top of the enclosed food container to enclose said second compartment and insulate the food container enclosed within said second compartment;

an elongate strap member connected to one of said opposed side portions and being of sufficient length to pass over said cooler open and closable lid;

releasable fastener means connected with said strap member and with the other one of said opposed side portions for releasably securing said strap member over said cooler open and closable lid; whereby a food container containing food and other articles of one type is releasably secured beneath the bottom of said cooler and is conveniently carried therewith as a single unit and isolated from food, beverages and other articles of another type contained in said cooler; and said cooler being selectively capable of use independently of said sling member when disconnected therefrom for containing food, beverages, and other articles.

* * * * *